US010285434B2

(12) United States Patent
Park et al.

(10) Patent No.: US 10,285,434 B2
(45) Date of Patent: May 14, 2019

(54) SMOKING ARTICLE AND MANUFACTURE THEREOF

(75) Inventors: Kie Seon Park, London (GB); Robert Whiffen, London (GB); Gary Fallon, London (GB); Frédéric Louis, Chilly-Mazarin (FR)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 1167 days.

(21) Appl. No.: 14/345,144

(22) PCT Filed: Sep. 4, 2012

(86) PCT No.: PCT/EP2012/067175
§ 371 (c)(1),
(2), (4) Date: Oct. 17, 2014

(87) PCT Pub. No.: WO2013/037664
PCT Pub. Date: Mar. 21, 2013

(65) Prior Publication Data

US 2015/0034100 A1 Feb. 5, 2015

(30) Foreign Application Priority Data

Sep. 15, 2011 (EP) ..... 11290424

(51) Int. Cl.
*A24D 1/04* (2006.01)
*A24D 1/02* (2006.01)
(Continued)

(52) U.S. Cl.
CPC ..... *A24D 1/02* (2013.01); *A24C 5/007* (2013.01); *A24C 5/02* (2013.01); *A24C 5/46* (2013.01);
(Continued)

(58) Field of Classification Search
CPC ..... A24D 1/047; A24D 3/0266; A24C 5/22; A24C 5/007; A24C 5/02; A24C 5/46
(Continued)

(56) References Cited

U.S. PATENT DOCUMENTS 1,934,694 A 11/1933 Brashear
2,827,903 A 3/1958 Niederman
(Continued)

FOREIGN PATENT DOCUMENTS

CA 2183825 C 2/1997
DE 19604427 A1 8/1997
(Continued)

OTHER PUBLICATIONS

International Search Report and Written Opinion, dated Mar. 7, 2013, for PCT/EP2012/067175, filed Sep. 4, 2012.
(Continued)

*Primary Examiner* — Jacob T Minskey
*Assistant Examiner* — Baileigh K Darnell
(74) *Attorney, Agent, or Firm* — Cantor Colburn LLP

(57) ABSTRACT

A smoking article comprises a rod of smokeable material such as tobacco and a tubular support in which the rod is slidably received. The tubular support is formed from a blank of sheet material that is wound in a spiral. Machinery for making the spiral blank is described.

18 Claims, 11 Drawing Sheets

(51) Int. Cl.

| | |
|---|---|
| ***A24D 3/02*** | (2006.01) |
| ***A24F 13/16*** | (2006.01) |
| ***A24C 5/46*** | (2006.01) |
| ***A24C 5/00*** | (2006.01) |
| ***A24C 5/02*** | (2006.01) |

(52) U.S. Cl.
CPC ..... *A24C 5/465* (2013.01); *A24D 1/045* (2013.01); *A24D 1/047* (2013.01); *A24D 3/0275* (2013.01); *A24F 13/16* (2013.01)

(58) Field of Classification Search
USPC ..... 131/281
See application file for complete search history.

(56) References Cited

U.S. PATENT DOCUMENTS

| | | | | |
|---|---|---|---|---|
| 3,794,048 | A | 2/1974 | Molins et al. | |
| 3,927,681 | A | 12/1975 | Bramhill | |
| 4,121,597 | A | 10/1978 | Shin | |
| 4,809,718 | A | 3/1989 | Deal | |
| 5,088,507 | A * | 2/1992 | Baker | A24F 47/004 131/280 |
| 9,113,658 | B1 * | 8/2015 | Sinclair, Jr. | A24D 1/022 |
| 9,351,521 | B2 * | 5/2016 | Drezen | A24C 1/30 |
| 2002/0050128 | A1 * | 5/2002 | Spatafora | B65B 19/225 53/461 |
| 2002/0074010 | A1 | 6/2002 | Snaidr et al. | |
| 2007/0199570 | A1 | 8/2007 | Drabner | |
| 2009/0084392 | A1 | 4/2009 | Fiebelkorn | |
| 2013/0140197 | A1 * | 6/2013 | Fiebelkorn | A24D 1/042 206/205 |
| 2013/0199551 | A1 * | 8/2013 | Le Roux | A24C 5/471 131/284 |

FOREIGN PATENT DOCUMENTS

| | | | | |
|---|---|---|---|---|
| EP | 0567891 | B1 | 12/1996 | |
| EP | 0790782 | B1 | 6/1999 | |
| EP | 2755508 | | 3/2017 | |
| GB | 264242 | A * | 1/1927 | A24C 5/22 |
| GB | 936772 | A | 9/1963 | |
| GB | 2210546 | A | 6/1989 | |
| GB | 2284339 | A | 6/1995 | |
| JP | 3516699 | U | 7/1960 | |
| JP | 47-7800 | A | 4/1972 | |
| JP | 4715028 | Y | 5/1972 | |
| JP | 53-042980 | A | 4/1978 | |
| JP | H09058697 | A | 3/1997 | |
| JP | 2006007505 | A | 1/2006 | |
| KR | 10-2009-0065492 | A | 6/2009 | |
| WO | 02078472 | A1 | 10/2002 | |
| WO | 2010097258 | A1 | 9/2010 | |

OTHER PUBLICATIONS

Written Opinion of the International Preliminary Examining Authority, dated Sep. 9, 2013, for PCT/EP2012/067175, filed Sep. 4, 2012.
International Preliminary Report on Patentability, dated Dec. 4, 2013, for PCT/EP2012/067175, filed Sep. 4, 2012.
European Search Report and European Search Opinion, dated Feb. 17, 2012, for EP 11290424.8, filed Sep. 15, 2011.
First Office Action, CN Appln. No. 2012280044881.6; dated Jun. 1, 2015.
JP Search Report dated Feb. 12, 2015 re: Application No. 2014-530151, pp. 1-31, citing: GB 02210546, JP 553-042980A, JP S35-016699, JP 547-007800A, US03794048A, JP S47015028, JP 2006-007505A and JP H09-058697A.

* cited by examiner

SMOKING ARTICLE AND MANUFACTURE THEREOF

CLAIM FOR PRIORITY

This application is the National Stage of International Application No. PCT/EP2012/067175, filed Sep. 4, 2012, which in turn claims priority to and benefit of European Patent Application No. EP11290424.8, filed Sep. 15, 2011. The entire contents of the aforementioned applications are herein expressly incorporated by reference.

FIELD

This specification relates to a smoking article, apparatus for making the smoking article and machinery for making a wrapper for use in the smoking article.

SUMMARY

Embodiments of a smoking article described herein comprise a rod of smokeable material and a tubular support in which the rod is slidably received between a retracted position and an extended operative position, wherein the tubular support has been formed from a blank of sheet material wound in a spiral.

The tubular support may be formed by rolling the blank about the longitudinal axis of the tubular support such that opposed edges of the blank that extend longitudinally of the tubular support overlap and are attached to one another in their region of overlap.

Also described is a method of making a smoking article comprising a rod of smokeable material and a tubular support in which the rod is slidably received between a retracted position and an extended operative position, comprising winding a blank of sheet material in a spiral to form the tubular support.

Also described is a smoking article including a rod of smokeable material, a filter segment and tipping paper attaching the filter segment to one end of the rod, the tipping paper being wound in a spiral around the filter segment and a portion of the rod.

Machinery for manufacturing smoking articles is described which includes a cutting station for cutting wrapper banks from a web of sheet material, the blanks having a non rectangular periphery such that they can be wound in a spiral around a smoking article rod, and a gluing station to apply adhesive such that the blanks have adhesive applied to edge regions thereof and a major portion the surface of the blanks remain free of the applied adhesive.

BRIEF DESCRIPTION OF THE DRAWINGS

In order that the invention may be more fully understood, an embodiment thereof will now be described by way of illustrative example with reference to the accompanying drawings in which.

DETAILED DESCRIPTION

FIGS. 1 to 4 show an example of a smoking article that is extensible prior to use. The smoking article comprises a rod 1 of smokeable material that is slidably received in a tubular support 2. The rod 1 and support 2 have a common longitudinal axis X-X' and the rod 1 can slide within the tubular support 2 back and forth along the longitudinal axis between an extended, operative position shown in FIG. 2 and a non-extended or retracted, storage position shown in FIG. 3. The rod 1 may contain tobacco, tobacco derivatives, expanded tobacco, reconstituted tobacco, tobacco substitutes or like smokeable material and also heat-not-burn materials.

Figure 4:
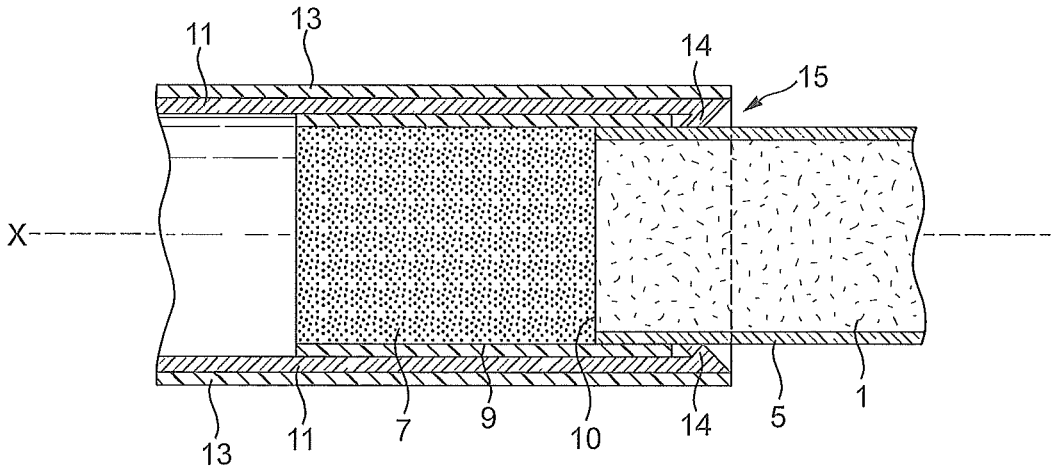
FIG. 4 is an enlarged, partial view of the arrangement shown in FIG. 3.

The rod 1 of smokeable material may comprise tobacco or like material 4 wrapped in a paper wrapper 5 which in use is lit at distal end 6 of the rod 1. A filter segment 7 made for example of cellulose acetate material is attached to proximal end 8 of rod 1 by tipping paper 9 in a manner well known per se. Referring to FIG. 4, the tipping paper 9 overlaps the end of the wrapper 5 of rod 1 to locate the filter 7 in place, providing a peripheral step 10 where the tipping paper 9 overlaps the wrapper 5.

The tubular support 2 is formed by rolling a blank n illustrated in FIG. 5 to form a spiral configuration described in more detail hereinafter. The tubular support 2 includes a further filter segment 12 at its buccal or proximal end 12*a*. The filter 12 may have the same or different filtering characteristics as compared with the filter 7 and either of the filters 7, 12 may include additives for selectively adsorbing smoke constituents or flavourants. The tubular support 2 may further include an outer wrapper 13 shown in FIGS. 2, 3 and 4 which may comprise a rectangular sheet to which glue is applied over an entire surface and wrapped over the rolled blank 11 to rigidify the structure. The longitudinal edges of the wrapper 13 may form a but joint which runs parallel to the axis X-X' of the tubular support. The outer wrapper 13 has been omitted from FIG. 1 to dearly show the detail of the spiral wrapping of the blank 11 to be described hereinafter.

The tubular support 2 has a re-entrant flap 14 at its distal end 15. As shown in FIG. 4, the flap 14 engages the step 10 formed by the tipping paper 9 so as to prevent the rod 1 of smokeable material from being withdrawn entirely from the tubular support 2 when moved to the extended position shown in FIGS. 2 and 4.

Figure 1:
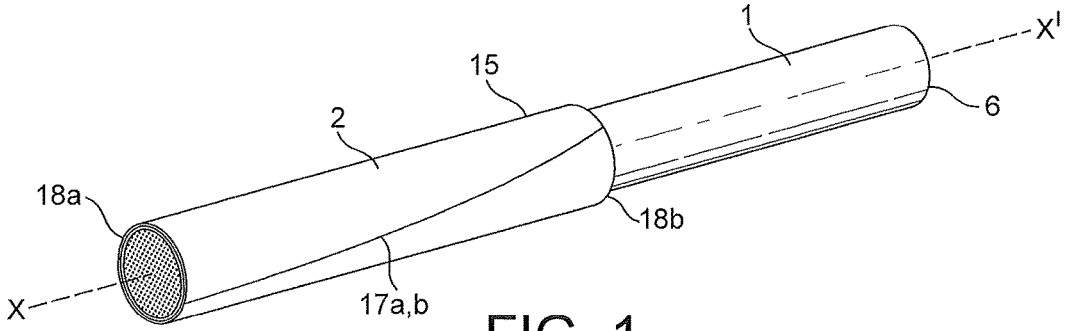
FIG. 1 is a schematic perspective view of a smoking article in an extended, operative configuration.
Figure 2:
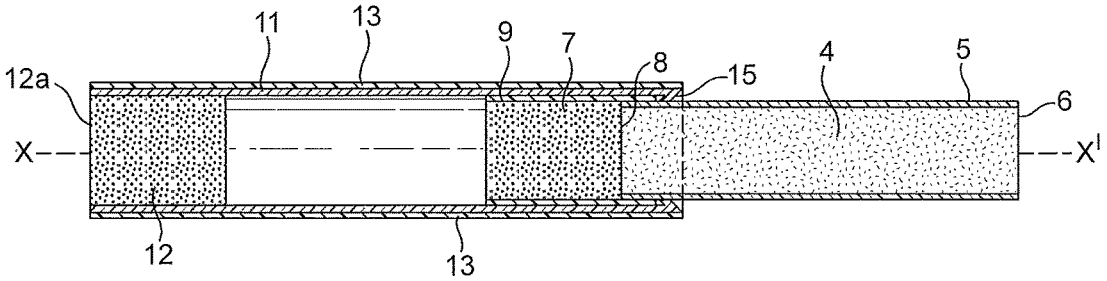
FIG. 2 is an axial sectional view of the smoking article of FIG. 1 in the extended configuration.
Figure 3:
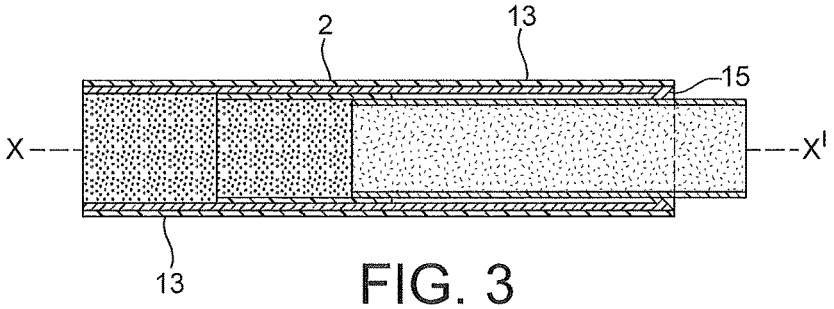
FIG. 3 corresponds to the view of FIG. 2 but with the smoking article in a non-extended or retracted storage configuration.

In use, the smoker manually extends the tobacco rod 1 from the retracted, storage position shown in FIG. 3 to the extended, operative position shown in FIGS. 1 and 2, so as to protrude from the tubular support 2. The tobacco rod 1 is then lit at its distal end 6 and smoke is drawn from the buccal end 12*a* of the tubular support 2 through the filters 7, 12. The rod 1 can be extinguished after use by sliding the remainder of the rod 1 back into the tubular support 2, conveniently storing residual ash in the support 2.

Figure 5:
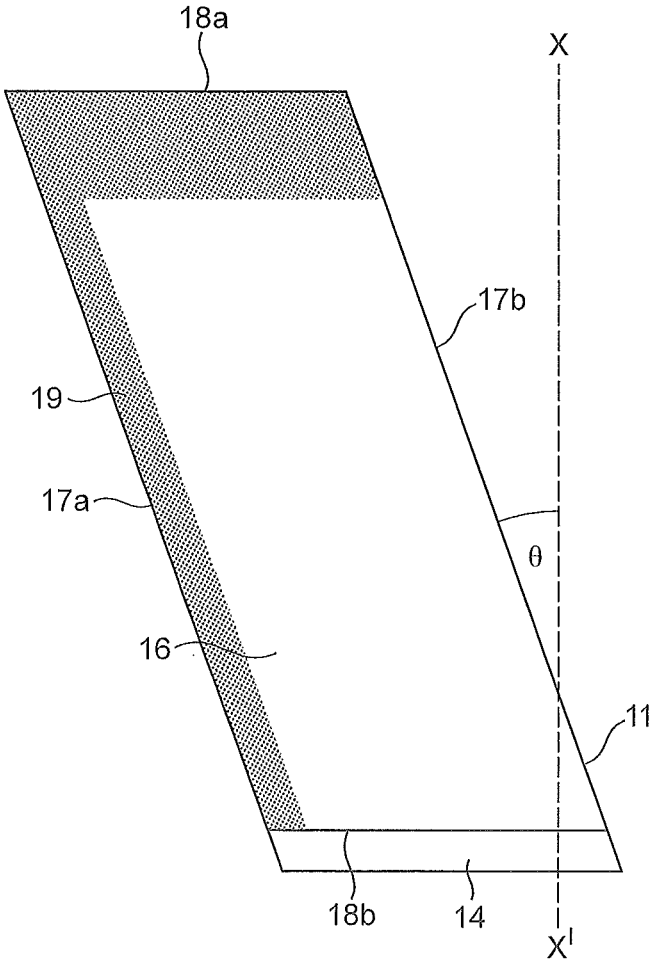
FIG. 5 illustrates a blank for forming a tubular support for the smoking article.

Referring to FIG. 5, the blank n of sheet material used in the support 2 includes a major portion 16 and a minor portion that forms the re-entrant flap 14. The major portion 16 has a non-rectangular, symmetrical quadrilateral periphery, in this example a parallelogram, with longitudinal, opposed mutually parallel major side edges 17*a*, 17*b* and opposed, transversely extending minor parallel side edges 18*a*, 18*b*. In the example shown in FIG. 5 the blank n has the shape of a rhombus but can be of other shapes which provide a spiral wrap.

When laid flat as shown in FIG. 5, the major and minor side edges 17, 18 are arranged in a mutually non-rectangular configuration i.e. are non-orthogonal and the longitudinal edges 17 are arranged at an angle θ to the longitudinal axis X-X' so that the blank 11 can be rolled about the longitudinal axis in a spiral pattern, as can be seen from FIG. 1, with a longitudinal edges 17*a*, 17*b* forming a spiral along the length of the tubular support 2.

A region of adhesive 19 is applied along the region of edge 17*a* so that the edges 17*a*, 17*b* can be attached to one another by means of the adhesive in their region of overlap. The blank 11 is conveniently made of tipping paper material although other suitable sheet materials can be used. The sheet material of blank 11 may have a weight of 40-45 gsm and the outer sheet 13 may have a weight of 50-60 gsm but these ranges are by way of illustrative example only.

Prior to rolling the blank 11, the minor portion 14 of the blank is folded inwardly to form the re-entrant flap shown in FIG. 4, which engages the step 10 on the tipping paper 9, to ensure that the rod 1 cannot be pulled out fully from the tubular support 2.

It has been found that by winding the blank n of sheet material in a spiral, there is minimal tendency for the diameter of the tubular support to increase from the proximal end 13 to the distal end 15 and in this way, the tubular support 2 can be wound tightly at the distal end 15 onto the tobacco rod 1 to ensure that the re-entrant flap 14 reliably engages with the step 10 to prevent the rod 1 from being pulled completely out of the tubular support 2. By way of comparison, if the blank 11 were made rectangular and with longitudinal edges running parallel to the longitudinal axis X-X' of the tubular support 2, there would be a tendency for the re-entrant flap 14 to be a loose fit around the tobacco rod which may result in the rod being completely released from the tubular support when moved to the extended configuration shown in FIG. 2. It will be understood that the distal end 15 of the blank 11 cannot be glued to the tobacco rod 1 beneath to secure it in place because this would prevent the rod 1 from sliding in the tubular support 2 and that glue can only be used in limited areas of the tubular support 2.

If the angle θ shown in FIG. 5 is made between 5° and 10°, a secure, close fit can be achieved between the re-entrant flap 14 and the step 10. Larger values of θ can also be utilised although this may use up more wrapping material during the manufacturing process.

Figure 6:
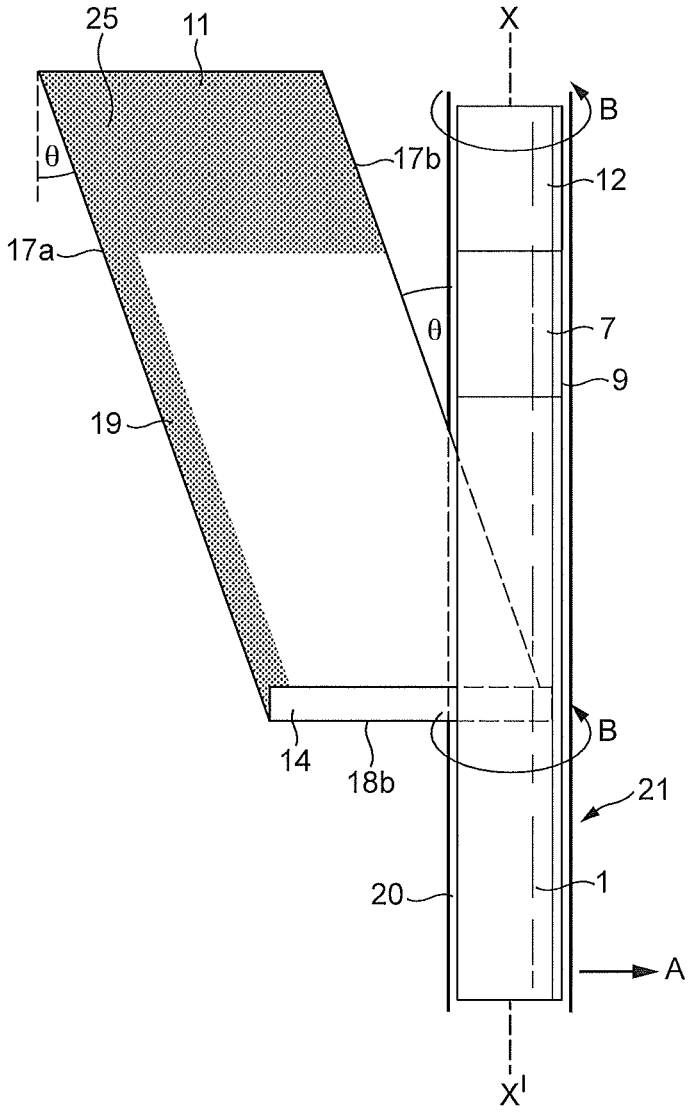
FIG. 6 schematically illustrates the rolling of the blank of FIG. 5 to form the tubular support.

An example of manufacture of the smoking article will now be described by way of illustration with reference to FIGS. 6 and 7. The tobacco rod 1 with filter 7 attached by means of tipping paper 9, is laid in an axial groove 20 in the cylindrical surface of a rotary wrapping drum 21. The second filter 12 is also placed in groove 20 in abutment with filter 7. The blank 11 is inserted under the rod 1 as illustrated in FIG. 6, the minor portion 14 having previously been folded inwardly as shown in FIG. 6 about edge 18*b* in order to form the re-entrant flap 14.

Figure 7:
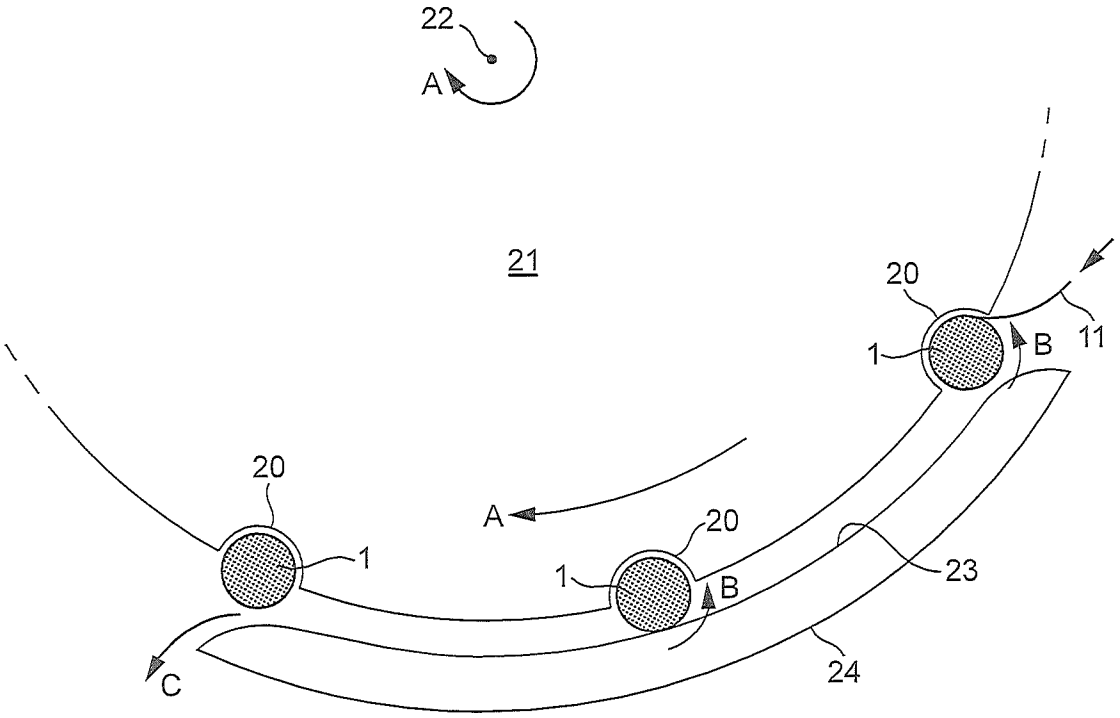
FIG. 7 is a schematic illustration of apparatus for performing the rolling of the tubular support from the blank around a rod of smokeable material.

As shown in FIG. 7, the drum 21 rotates in the direction of arrow A about axis 22, underneath a semi-cylindrical roller guide surface 23 formed on a guide member 24 so that the rod 1, filters 7, 12 and blank 11 are subject to a rolling action whilst in the groove 20, in the direction of arrow B, which rolls the blank n around the filter 12 and tobacco rod 1 to form the tubular support 2. It will be understood that the blank 11 is wound in a spiral at angle θ to the longitudinal axis X-X' of the smoking article. The edges 17*a*, 17*b* are thereby wound into an overlapping relationship and the glue 19 formed along the overlapping region adheres the overlapping edges 17*a*, 17*b* to one another to form the tubular support 2. Also, the filter 12 becomes in wrapped in the blank 11. An additional portion of glue 25 may be provided on the wrapper 11 in order to secure the filter 12 in place at the buccal end 13 of the resulting tubular support 2 for example over the entire cylindrical surface area of the filter 12.

As shown in FIG. 7, the drum 21 includes a number of the parallel grooves 20 so that smoking articles can be mass produced in succession, with completed smoking articles 1,2 falling out of successive grooves 20 in the direction of arrow C. In a separate finishing step (not shown) the ends of the smoking articles may be trimmed to create clean cut ends, which provides improved smoker acceptance.

Machinery for forming the blanks n that are supplied to the rolling machine of FIGS. 6 and 7 will now be described with reference to FIGS. 8 to 11.

Figure 8:
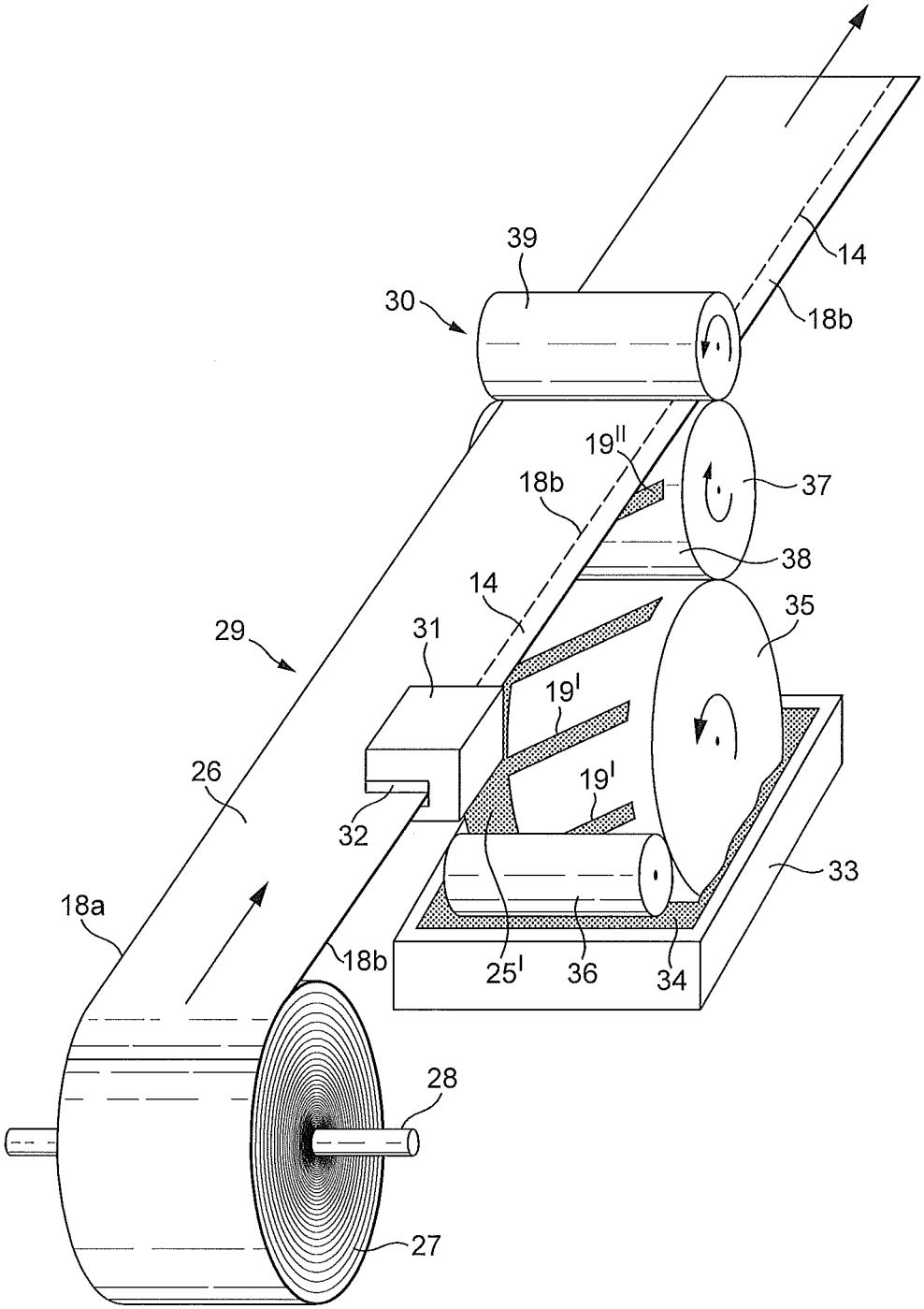
FIG. 8 is a schematic perspective view of a device for edge folding a paper web supplied from a roll and a station for applying a pattern of glue to the folded web for use in forming successive blanks for the tubular support.

Referring to FIG. 8, a web of paper 26 in a roll 27 mounted on a rotary spindle 28 is fed through a folding station 29 and then a gluing station 30 at which a pattern of adhesive is applied. The web 26 then passes to a cutting station illustrated in FIGS. 10 and 11 where the individual blanks 11 are cut from the web 26.

The folding station shown 29 shown in FIG. 8 includes a folding block 31 that includes a slot 32 which acts to fold the edge 18*b* of the web inwardly so as to form the re-entrant flap 14 when later cut into the blanks 11.

The gluing station 30 shown in FIG. 8 includes a reservoir 33 containing liquid adhesive 34, an impression roller 35 which rotates in the reservoir to be coated with the adhesive 34 in a predetermined pattern corresponding to the regions 19, 25 of the blank 11. The surface of the impression roller 35 may comprise a plate treated by conventional offset lithographic printing techniques to define the adhesive pattern, which includes strips 25' corresponding to the glue region 25 of successive blanks 11 and regions 19' corresponding to glue regions 19 of the successive blanks 11. A control roller 36 removes excess glue from the impression roller 35 so that glue resides substantially only on the regions 19', 25'.

Figure 9:
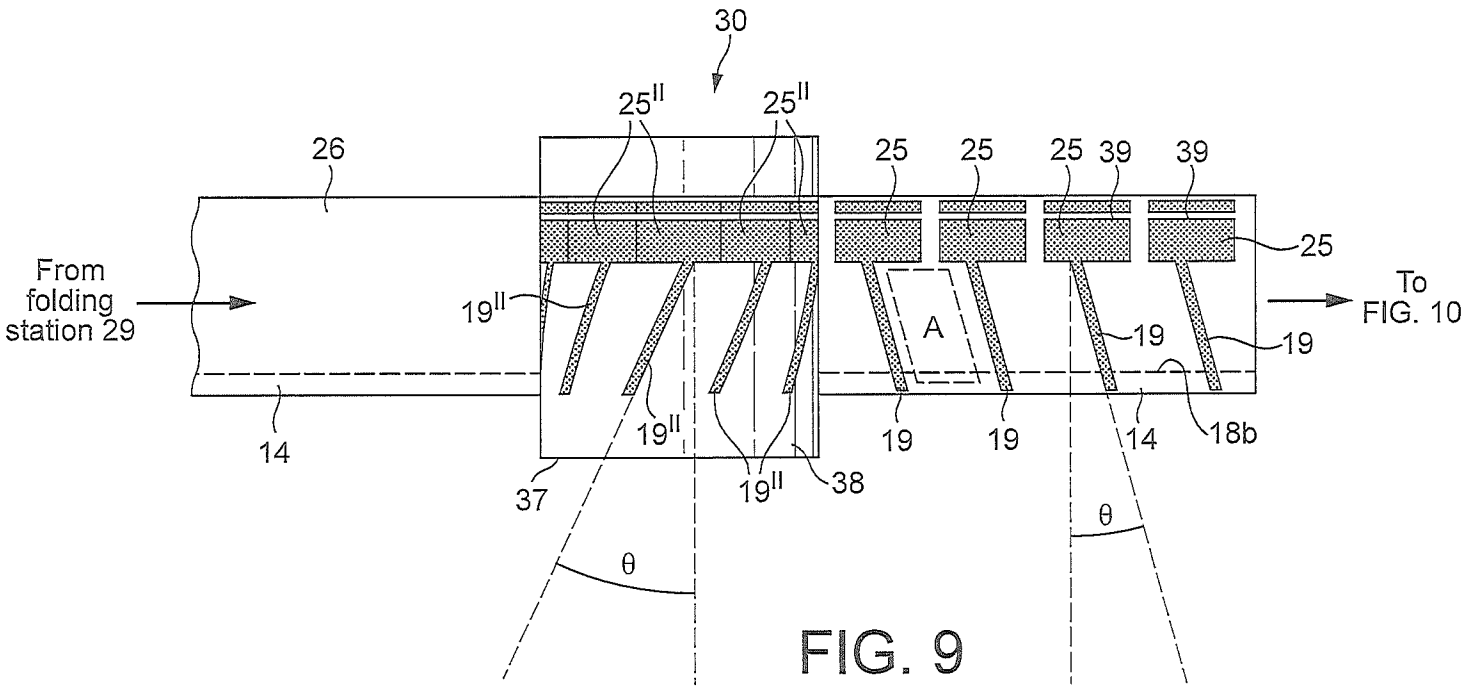
FIG. 9 is a view from below of a pattern of glue applied by a transfer roller to the web at the gluing station shown in FIG. 8.

The impression roller 35 is in rotary engagement with a transfer roller 37 and has a cylindrical surface 38 that receives the pattern of adhesive 19', 25' from the impression roller 35 to form pattern 19", 25" as shown in more detail in FIG. 9. The folded web 26 from the folding station 29 passes between the transfer roller 37 and a pinch roller 39 so that the pattern of glue on the transfer roller is transferred to the underside of the web as shown in FIG. 8. The resulting pattern of adhesive on the web is shown in detail in FIG. 9 and comprises a succession of regions 19 inclined at angle (90-θ)° to the length of the web 26 and regions 25 corresponding to the regions to be glued to the second filter 12. It will be seen that a narrow region 39 free of adhesive extends through the region 25 close to the edge 18*a*. This allows the end of the eventual cigarette to be trimmed through the adhesive-free region 39 to provide a sharply defined mouth end of the finally formed cigarette in the aforementioned finishing step described with reference to FIG. 7. The web 26 with the pattern of adhesive applied then passes to the cutting station shown in FIGS. 10 and 11.

The cutting station includes a cylindrical cutting roller 40 that includes elongate cutting blades 41 arranged with equal spacing around the cylindrical circumference of the roller 40, at angle θ to the axis of rotation Y-Y' of the roller 40. The web with the pattern of adhesive applied as previously described (not shown in FIGS. 10 and 11) passes between the cutting roller 40 and a cutting support roller 43 which may be made of a ceramic material to provide a hard cutting surface, such that the web 26 is cut into successive ones of the blanks 11 for use in the rolling machine shown in FIGS. 6 and 7.

An input roller arrangement 44 for the cutting station controls the phase and tension of the web 26 as it passes between the cutting roller 40 and the support roller 43. The input roller arrangement 44 includes first and second web guide rollers 45, 46 between which is mounted an eccentric guide member 47 that can be turned about axis Z-Z' to apply a variable force against the upper surface of the web 26 and thereby controllably vary the tension and phase of the web 26 entering under the cutting roller to ensure that the cuts made in web 26 occur with equal spacing, so as to produce banks 11 of equal size and shape reliably.

Figure 10:
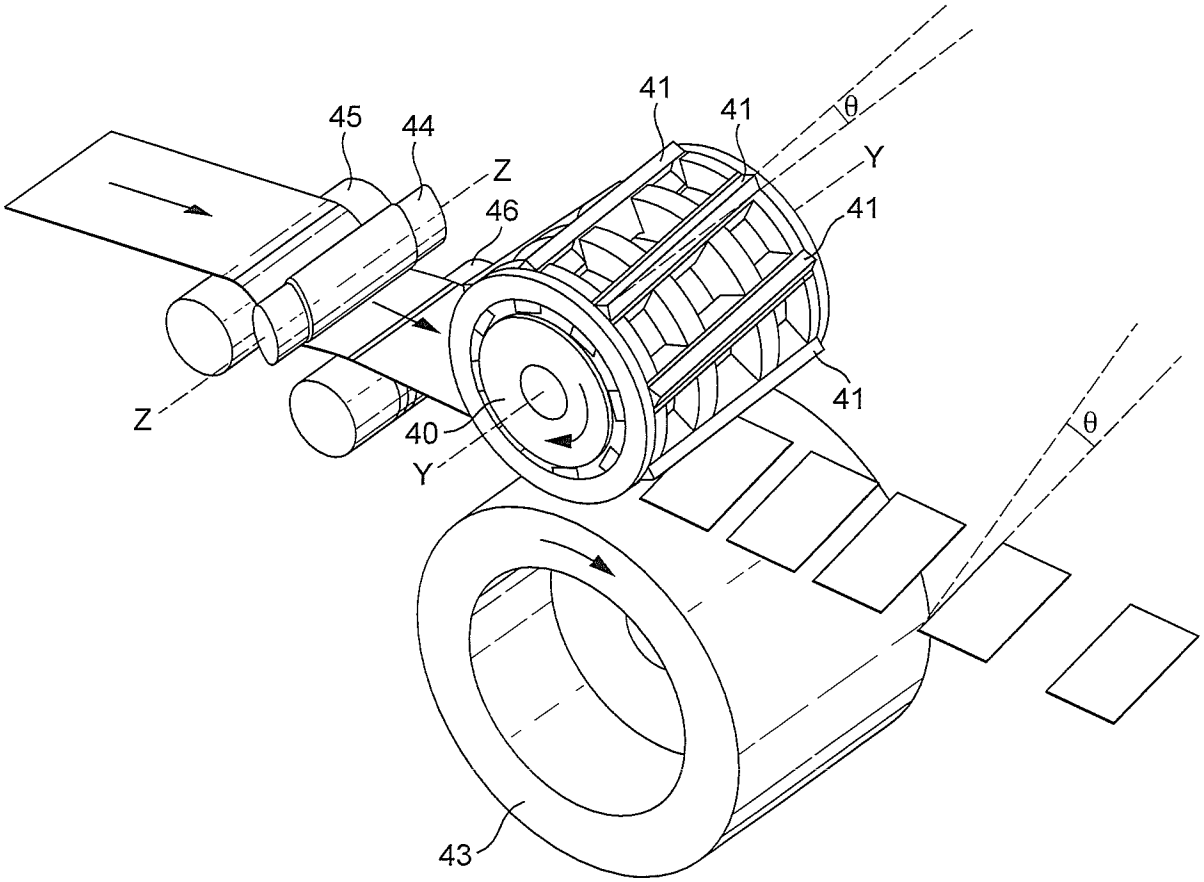
FIG. 10 illustrates in perspective a rotary cutting station to cut individual wrappers from the web after the glue has been applied.
Figure 11:
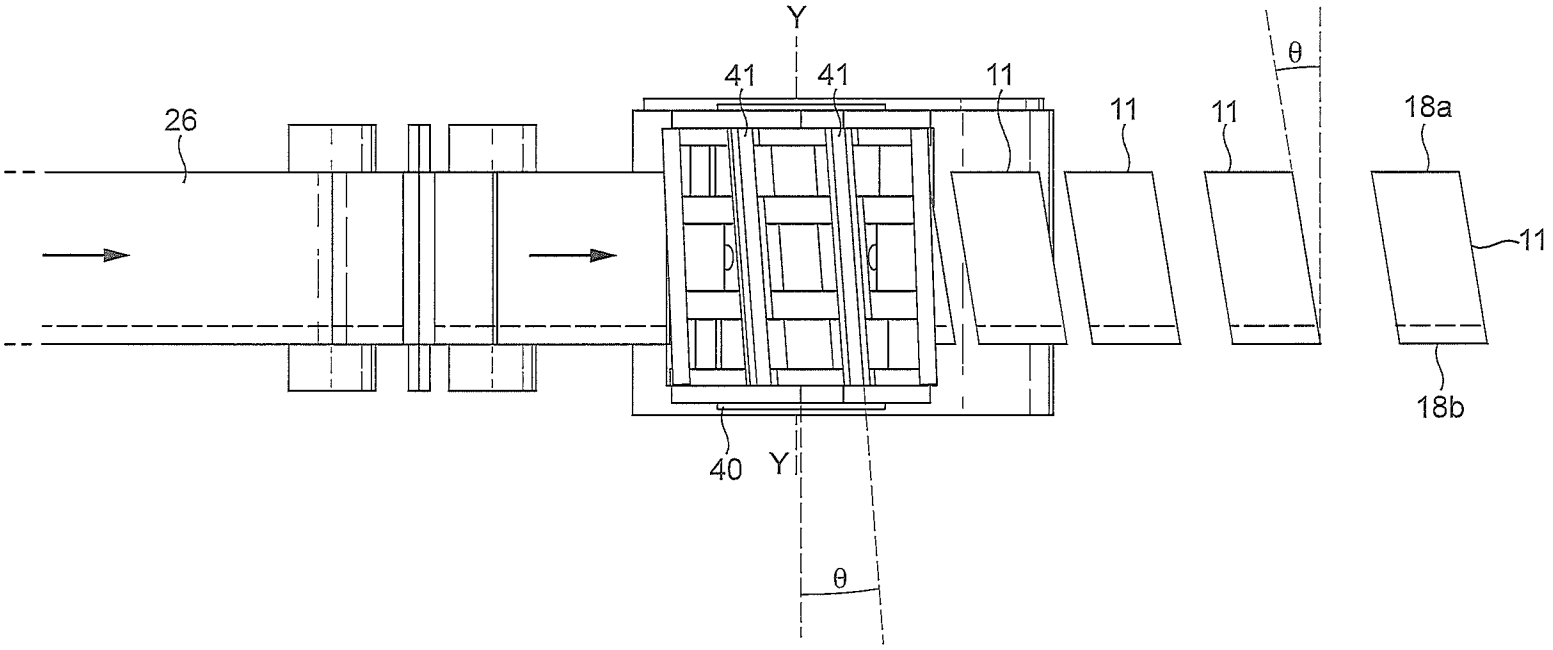
FIG. 11 is a plan view of the cutting station.

The folding station 29, gluing station 30 and the cutting station shown in FIGS. 10 and 11 can be retrofitted to a conventional cigarette making machine such as the Hauni Max made by Hauni Maschinenbau AG.

Figure 12:
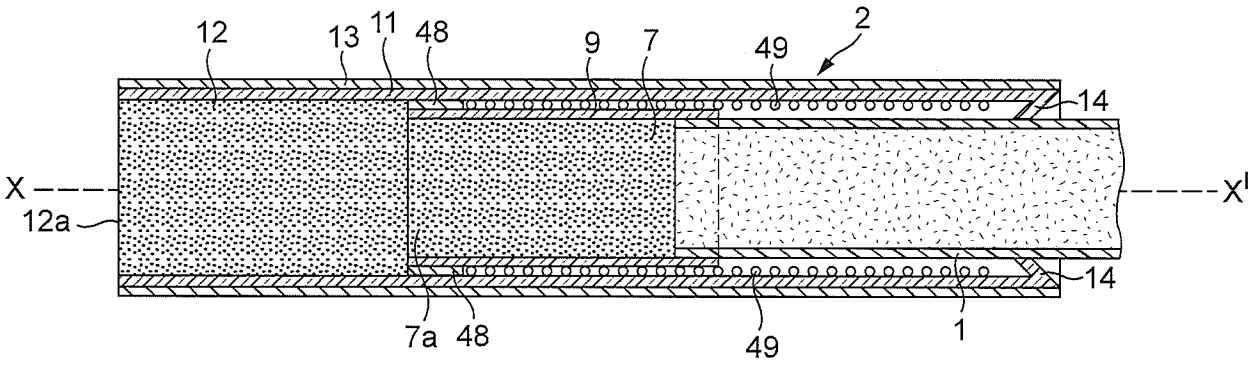
FIG. 12 illustrates another embodiment of smoking article in section when unextended.
Figure 13:
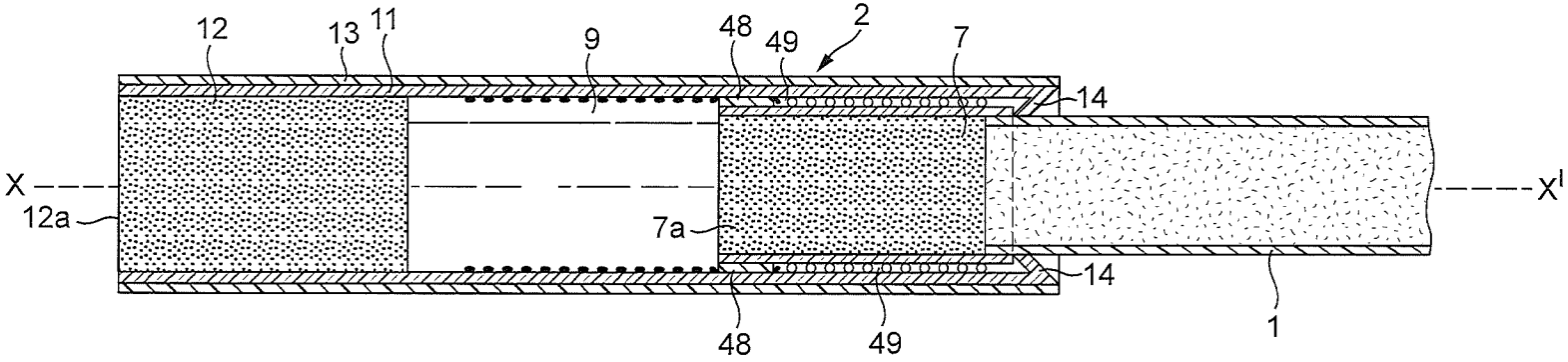
FIG. 13 corresponds to FIG. 12 with the smoking article shown extended.

Another example of smoking article is shown in FIGS. 12 and 13 which can be considered as a modification of the article shown in FIGS. 1 to 5. This example includes material that can modify characteristics of the smoke upon extension of the cigarette. The smoking article of FIG. 12 is extensible prior to use and comprises rod 1 of smokeable material that is received in tubular support 2 to slide on a common longitudinal axis X-X' back and forth along the longitudinal axis between an extended position shown in FIG. 13 and a retracted position as shown in FIG. 12. The rod 1 may contain tobacco, tobacco derivatives, expanded tobacco, reconstituted tobacco, tobacco substitutes or like smokeable material and also heat-not-burn materials. The rod 1 is attached to filter 7 by tipping paper 9 as described above.

The tubular support 2 comprises a spiral wound blank 11 as described previously that is glued to the filter 12 at the buccal end and includes a re-entrant flap 14 at the distal end to retain the rod 1 within the support 2. Outer wrap 13 is glued to the entire outer surface of the spiral blank 11. An activating wrapper 48 is glued or otherwise affixed to the buccal end of the filter 7 overlying the tipping paper 9 and so the rod 1 can be slid outwardly from the position shown until the wrapper 48 abuts the flap 14. The interior surface of the spirally wound blank 11 over which the activating wrapper 48 slides is coated with a material 49 that can modify characteristics of the smoke, which is activated by the sliding action. For example, the material 49 may comprise frangible microcapsules that contain a flavourant, which are broken open when the wrapper 48 passes over them allowing the flavourant to mix with smoke from the rod 1 passing to the smoker. Alternatively, the material 49 could comprise activated charcoal or other smoke fraction adsorbents. The material 49 can be laid in rings or other patterns so that as the rod 1 is pulled outwards an audible sound and/or a modulated resistance to the pulling force needed to extend the article is produced, indicating activation to the smoker. The material may be applied from a roller (not shown) in region A for each blank 11 shown in FIG. 9.

Figure 14A:
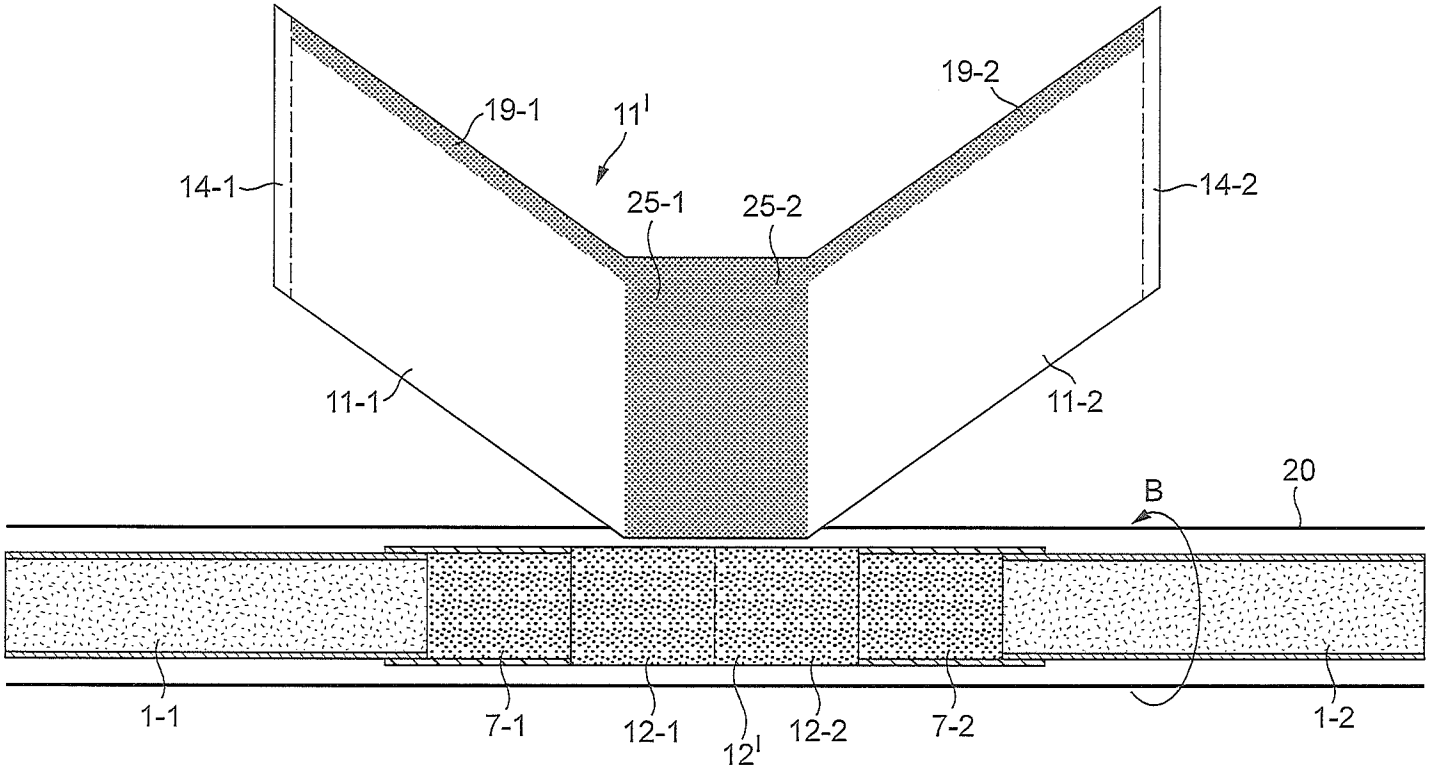
FIGS. 14A-C illustrate process steps in manufacturing two smoking articles back-to-back.
Figure 14B:
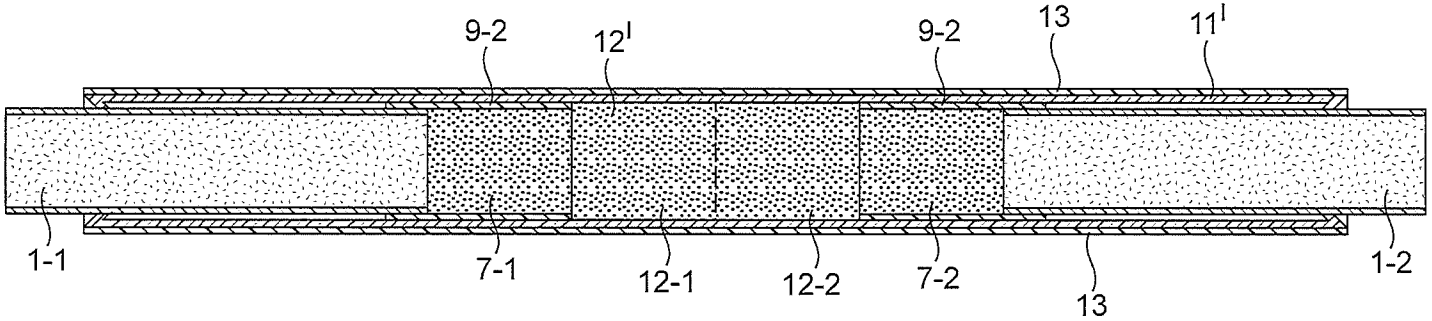
Figure 14C:
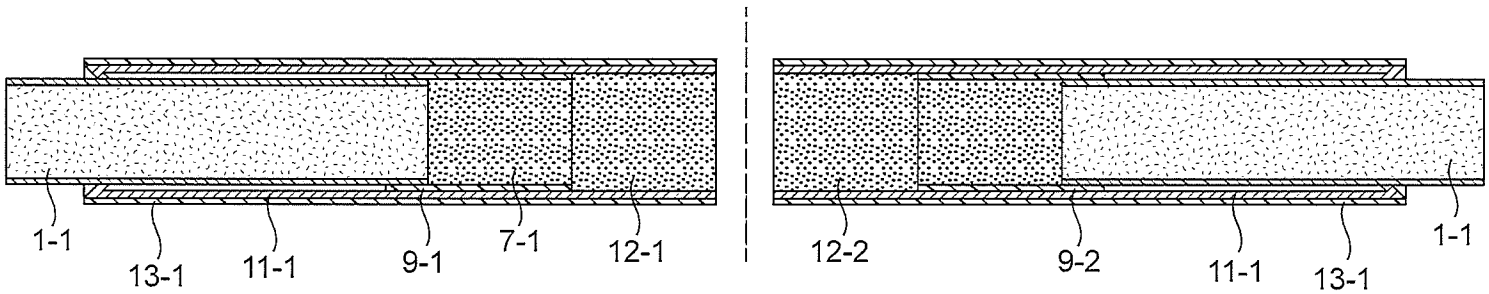

In the previously described manufacturing process, individual smoking articles are produced but the smoking articles can be produced in pairs back-to-back as illustrated in FIGS. 14A-C. In this arrangement, a generally chevron shaped wrapper 11' is utilised to wrap the components for two smoking articles arranged back-to-back. Referring to FIG. 14A, the wrapper 11' has a glue pattern 19-1, 19-2, 25-1, 25-2, applied by a modified version of the gluing station shown in FIG. 9 and the edges are folded over to form re-entrant flaps 14-1, 14-2 by a pair of the folding blocks 31 shown in FIG. 8, and are cut with suitably modified cutter blades at the cutting station as described with reference to FIGS. 10 and 11. The chevron shaped wrapper 11' is wrapped around two smoking article rods 1-1, 1-2 arranged back-to-back in groove 20 of the rolling drum 21, with respective first filters 7-1, 7-2 attached by tipping paper 9-1, 9-2. A unitary length of second filter rod 12' is disposed between the filters 7-1, 7-2. The drum 21 rolls the wrapper 11' around the rods and filters in groove 20 in the direction of arrow B to form the configuration shown in FIG. 14B which is subsequently cut along line 50 to form two smoking articles.

Many modifications and variations will be evident to those skilled in the art. For example, the outer wrapper 13 need not be rectangular and could be wound in a spiral rather than having an axially extending but joint between its longitudinal edges. The spiral of the outer wrapper 13 can be of opposite hand to that of the spiral wound blank 11 to provide additional strength to the tubular support 2. Also, the outer wrapper 13 can be omitted entirely if its strengthening characteristics for the tubular support are not required.

The tubular support 2 need not necessarily be wound in situ as shown in FIGS. 6 and 7 but could for example be formed of spiral wound blank n that is cut orthogonally to form individual lengths for each smoking article. Also, the longitudinal edges 17*a*, 17*b* need not necessarily be parallel to one another or rectilinear as shown in FIG. 6. Furthermore either or both of the filters 7, 12 could be omitted.

The blank 11 can also be used in other situations. For example the blank n formed of tipping paper, can be used to attach a filter segment to one end of a rod of smokeable material in a situation where the tipping paper is porous such as to provide a path for ventilation air into the filter when the smoker draws on the smoking article. Since glue is only applied to edge regions of the blank 11, the major portion of the surface area of the blank remains uncoated with glue such as to exhibit a level of porosity that can provide a ventilation path that is unimpeded by the glue.

In order to address various issues and advance the art, the entirety of this disclosure shows by way of illustration various embodiments in which the claimed invention(s) may be practiced and provide for superior smoking articles, wrappers and methods of making the same. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. A smoking article comprising; a rod of smokeable material and a tubular support in which the rod is received, the rod and tubular support configured to allow the rod to slide between a retracted position and an extended operative position relative to the tubular support, the tubular support comprising a spiral-wound blank of sheet material wound in a spiral at an angle of between 5° and 10° to the longitudinal axis of the tubular support.

2. The smoking article according to claim 1, wherein the tubular support blank includes a minor portion defining a re-entrant flap at an end of the tubular support, said re-entrant flap configured to prevent the rod from being slid completely out of the tubular support.

3. The smoking article according to claim 2, wherein the tubular support includes a buccal end and a distal end, the rod has a proximal end slidably received in the tubular support and a distal end protrudable from the tubular support, the rod and tubular support configured such that the rod is slidable within the support along a common longitudinal axis along; and the minor portion defining a re-entrant flap is at the distal end of the tubular support.

4. The smoking article according to claim 2, further comprising a filter at an end of the rod of smokeable material attached thereto by tipping paper to define a step, engageable by the re-entrant flap to prevent the rod from being removed completely from the tubular support.

5. The smoking article according to claim 1, wherein the blank has been rolled about said longitudinal axis such that opposed edges of the blank that extend longitudinally of the tubular support overlap and are attached to one another in a region of overlap.

6. The smoking article according to claim 5, wherein the longitudinally-extending edges are attached by means of an adhesive.

7. The smoking article according to any preceding claim 1, wherein the tubular support blank includes at least a major portion having a non-rectangular symmetrical quadrilateral periphery.

8. The smoking article according to claim 7, wherein the edges of said major portion define a parallelogram.

9. The smoking article according to claim 1, wherein the tubular support includes a filter at a buccal end thereof.

10. The smoking article according to claim 1, further comprising adhesive applied only to edge regions of the blank.

11. A method of making a smoking article comprising a rod of smokeable material and a tubular support in which the rod is slidably received, comprising: winding a blank of sheet material in a spiral to form the tubular support, such that the tubular support is configured to slidably receive a rod of smokeable material such that the received rod is slidable in the tubular support between a retracted position and an extended, operative position, wherein the blank of sheet material is wound in the spiral at an angle of between 5° and 10° to a longitudinal axis of the tubular support.

12. The method according to claim 11, including winding the blank around the rod of smokeable material in a spiral to form the tubular support.

13. The method according to claim 11, including adhering adjacent side edge regions of the wound blank.

14. The method according to claim 11, including folding a minor portion of the blank inwardly to form a re-entrant flap on the inside of the tubular support at one end such that the tubular support is configured to limit movement of the received rod outwardly of the tubular support from the retracted position to the operative position.

15. The method according to claim 11, wherein the rod has a filter attached thereto at one end by tipping paper and including rolling the blank, the blank having a re-entrant flap around the rod in a spiral.

16. Machinery for manufacturing smoking article components including:

a cutting station for cutting wrapper blanks from a web of sheet material, the cutting station configured to produce blanks having non-rectangular periphery such that they can be wound in a spiral around a smoking article rod to form a tubular support when wound in the spiral at an angle of between 5° and 10° to a longitudinal axis of the tubular support; and a gluing station to apply adhesive such that the blanks have adhesive applied to edge regions thereof and a major portion of the surface of the blanks remains free of the applied adhesive.

17. The machinery according to claim 16 including a folding station configured to fold an edge of the web inwardly prior to passage to the cutting station.

18. The machinery according to claim 16 wherein the gluing station is further configured to apply adhesive to the web in a predetermined pattern prior passing to the cutting station.

* * * * *